US005951894A

United States Patent [19]

White, Jr.

[11] Patent Number: 5,951,894

[45] Date of Patent: Sep. 14, 1999

[54] DUAL HEAD CURLING IRON WITH TIMER

[76] Inventor: Marion O. White, Jr., 839 Connafax Rd., Barnesville, Ga. 30204

[21] Appl. No.: 09/146,491

[22] Filed: Sep. 3, 1998

[51] Int. Cl.[6] ..... A45D 1/04

[52] U.S. Cl. ..... 219/222; 219/506

[58] Field of Search ..... 219/222, 221, 219/225, 227, 228, 240, 241, 242, 506; 132/233, 212; 368/29; 422/73; 374/169, 170

[56] References Cited

U.S. PATENT DOCUMENTS

| | | | |
|---|---|---|---|
| 2,197,876 | 4/1940 | Racen | 219/222 |
| 4,105,411 | 8/1978 | Biver | 422/73 |
| 4,258,731 | 3/1981 | Tsujimoto et al. | 132/9 |
| 4,385,841 | 5/1983 | Kramer | 368/29 |
| 4,418,268 | 11/1983 | Munshaw | 219/242 |
| 4,565,456 | 1/1986 | Iida et al. | 374/169 |
| 4,634,294 | 1/1987 | Christol et al. | 374/170 |
| 4,641,010 | 2/1987 | Abura et al. | 219/222 |
| 4,673,798 | 6/1987 | Contri et al. | 219/225 |
| 4,968,870 | 11/1990 | Moon | 219/222 |
| 5,160,831 | 11/1992 | Thaler et al. | 219/506 |

*Primary Examiner*—Teresa Walberg
*Assistant Examiner*—Quang Van

[57] ABSTRACT

A heated curling apparatus is provided including a handle. At least one of a brush attachment and a rod attachment is mounted on the handle for heating upon the supply of power thereto. Also included is a timer unit connected between a power source and the brush or rod attachment for supplying power thereto for a time interval.

8 Claims, 2 Drawing Sheets

DUAL HEAD CURLING IRON WITH TIMER

BACKGROUND OF THE INVENTION

1. Field of the Invention

The present invention relates to curling irons and more particularly pertains to a new dual head curling iron with timer for automatically activating a curling iron at a user-selected time for a predetermined duration.

2. Description of the Prior Art

The use of curling irons is known in the prior art. More specifically, curling irons heretofore devised and utilized are known to consist basically of familiar, expected and obvious structural configurations, notwithstanding the myriad of designs encompassed by the crowded prior art which have been developed for the fulfillment of countless objectives and requirements.

Known prior art curling irons include U.S. Pat. Nos. 4,851,641; U.S. Pat. No. 4,673,798; U.S. Pat. No. 5,354,967; U.S. Pat. No. 1,536,246; U.S. Pat. No. Des. 269,298; and U.S. Pat. No. 4,385,841.

In these respects, the dual head curling iron with timer according to the present invention substantially departs from the conventional concepts and designs of the prior art, and in so doing provides an apparatus primarily developed for the purpose of automatically activating a curling iron at a user-selected time for a predetermined duration.

SUMMARY OF THE INVENTION

In view of the foregoing disadvantages inherent in the known types of curling irons now present in the prior art, the present invention provides a new dual head curling iron with timer construction wherein the same can be utilized for automatically activating a curling iron at a user-selected time for a predetermined duration.

The general purpose of the present invention, which will be described subsequently in greater detail, is to provide a new dual head curling iron with timer apparatus and method which has many of the advantages of the curling irons mentioned heretofore and many novel features that result in a new dual head curling iron with timer which is not anticipated, rendered obvious, suggested, or even implied by any of the prior art curling irons, either alone or in any combination thereof.

To attain this, the present invention generally comprises a handle having a first end with a hemispherical configuration and a second end with a cylindrical socket. As shown in FIG. 5, such socket is equipped with an arcuate slot formed on a side surface thereof. Further, a pair of contacts are mounted on a bottom surface of the socket. As shown in FIG. 4, the handle has an intermediate extent ½ of which has a semi-cylindrical configuration and ½ of which has a planar rectangular configuration. Next provided is a brush attachment including an outer surface with a cylindrical configuration having a plurality of bristles coupled to the outer surface and extending radially therefrom. Associated therewith is a rod attachment including a metallic outer surface with a cylindrical configuration having a reduced diameter as compared to the brush attachment. The rod attachment is equipped with a spring-loaded clamp pivotally coupled to the rod attachment with an angled insulative grip. Both attachments have a plug coupled to an end thereof and extended therefrom in coaxial relationship therewith. A nub extends radially from a side surface of the plug while a pair of contacts are mounted on a bottom surface thereof. Such contacts are connected to a heater element within the attachment for heating upon the receipt of power. In use, the contacts of the attachments connect with those of the handle upon the insertion and rotation of the plug into the socket. As shown in FIGS. 1 & 3, a power cord includes a first end removably mounted to the first end of the handle. A second end of such cord has an AC/DC adapter for connecting to an alternating current receptacle and converting power received therefrom to DC power. FIG. 1 depicts a manual toggle switch mounted on the planar half of the handle adjacent to the second end of the handle. The manual toggle switch is connected between the contacts and the power cord for supplying the contacts of the handle with power in a first orientation. In a second orientation, the supply of power to the contacts of the handle is precluded. For indicating when power is supplied to the heating element of the current attachment, the toggle switch further includes a light situated therein for being illuminated when the switch is in the first orientation. Mounted on a wall in room where the present invention is used is a mounting plate. As shown in FIG. 6, the mounting plate includes bracket with an opening for receiving the handle for supporting the same. Finally, a timer unit is provided including a digital display mounted on the planar half of the handle adjacent to the first end of the handle. The timer unit is connected between the power cord and the contacts of the handle for supplying power thereto for a predetermined time interval of 30 minutes. The timer units starts supplying power at a user-selected time which is displayed on the digital display. Further, for safety purposes, the timer unit is adapted to supply power to the contacts of the handle only if the same is situated within the mounting plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dual head curling iron with timer apparatus and method which has many of the advantages of the curling irons mentioned heretofore and many novel features that result in a new dual head curling iron with timer which is not anticipated, rendered obvious, suggested, or even implied by any of the prior art curling irons, either alone or in any combination thereof.

It is another object of the present invention to provide a new dual head curling iron with timer which may be easily and efficiently manufactured and marketed.

It is a further object of the present invention to provide a new dual head curling iron with timer which is of a durable and reliable construction.

An even further object of the present invention is to provide a new dual head curling iron with timer which is susceptible of a low cost of manufacture with regard to both materials and labor, and which accordingly is then susceptible of low prices of sale to the consuming public, thereby making such dual head curling iron with timer economically available to the buying public.

Still yet another object of the present invention is to provide a new dual head curling iron with timer which provides in the apparatuses and methods of the prior art some of the advantages thereof, while simultaneously overcoming some of the disadvantages normally associated therewith.

Still another object of the present invention is to provide a new dual head curling iron with timer for automatically activating a curling iron at a user-selected time for a predetermined duration.

Even still another object of the present invention is to provide a new dual head curling iron with timer that includes a handle. At least one of a brush attachment and a rod attachment is mounted on the handle for heating upon the supply of power thereto. Also included is a timer unit connected between a power source and the brush or rod attachment for supplying power thereto for a time interval.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
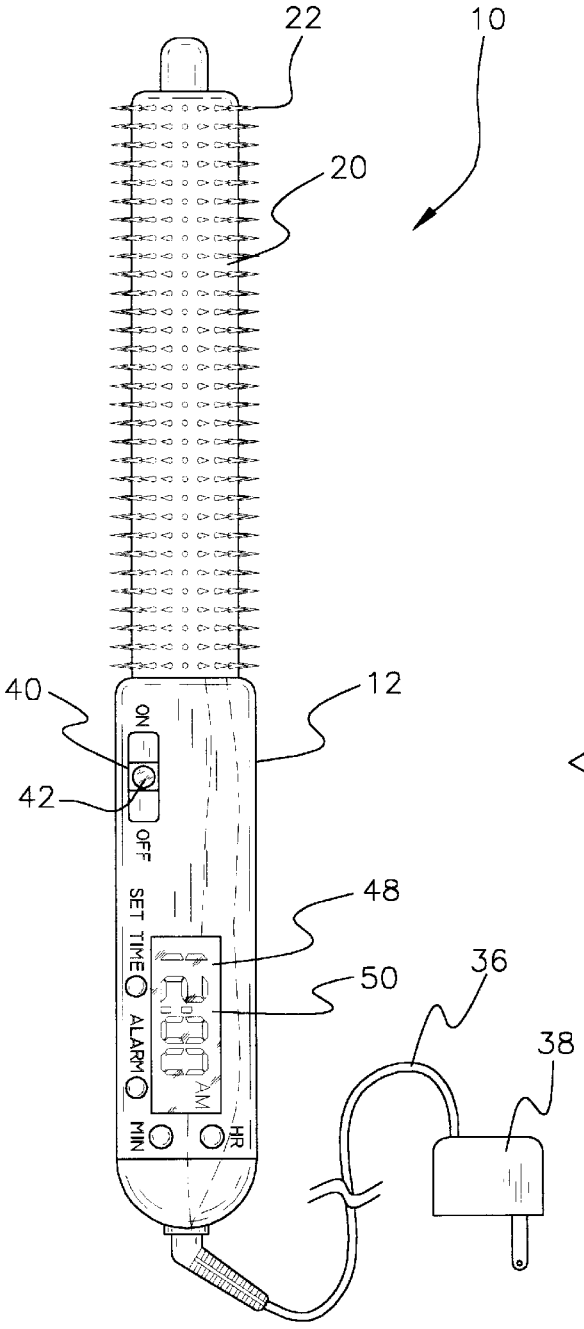
FIG. 1 is a top view of a new dual head curling iron with timer according to the present invention.
Figure 2:
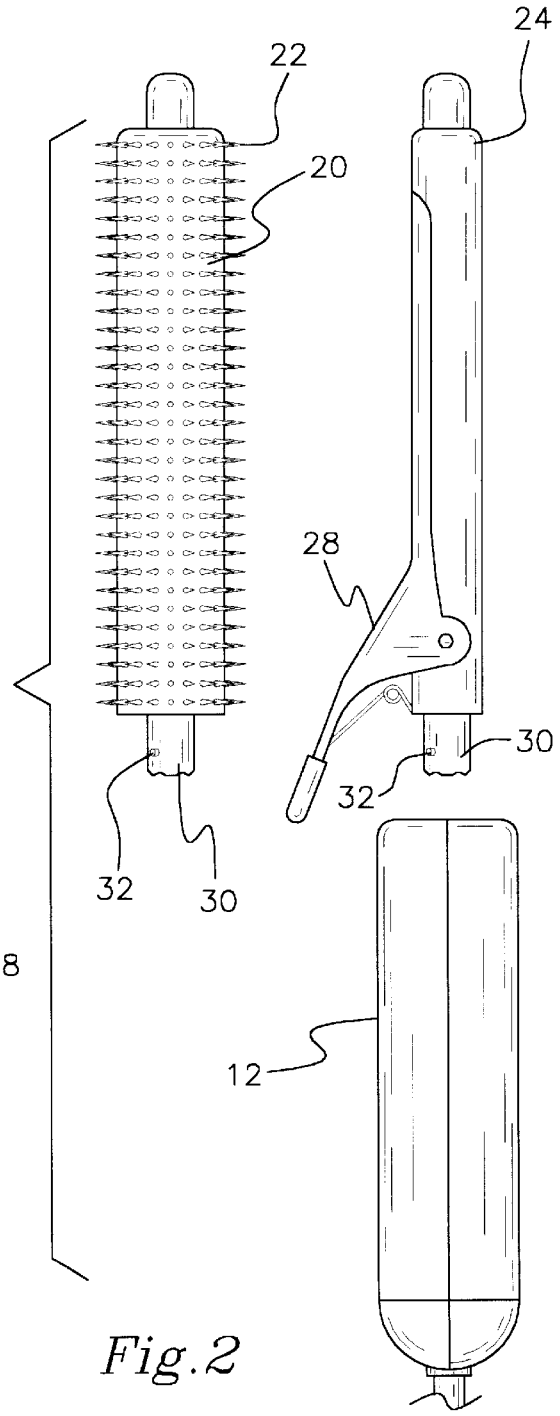
FIG. 2 is an exploded view of the attachments of the present invention.

With reference now to the drawings, and in particular to FIGS. 1 through 6 thereof, a new dual head curling iron with timer embodying the principles and concepts of the present invention and generally designated by the reference numeral 10 will be described.

Figure 4:
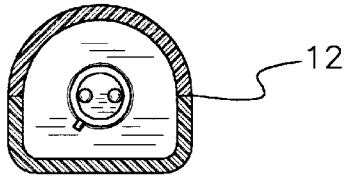
FIG. 4 is a cross-sectional view of the handle of the present invention taken along line 4—4 shown in FIG. 3.
Figure 5:
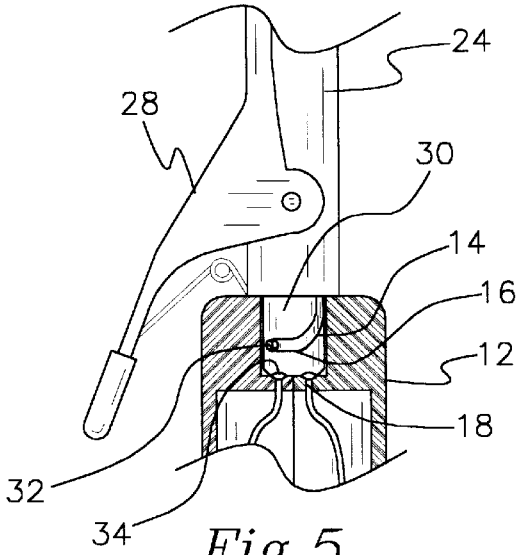
FIG. 5 is a cross-sectional view of the handle and rod attachment of the present invention showing the socket and plug, respectively.

The present invention, designated as numeral 10, includes a handle 12 having a first end with a hemispherical configuration and a second end with a cylindrical socket. As shown in FIG. 5, such socket 14 is equipped with an arcuate slot 16 formed on a side surface thereof. Further, a pair of contacts 18 are mounted on a bottom surface of the socket. As shown in FIG. 4, the handle has an intermediate extent half of which has a semi-cylindrical configuration and half of which has a planar rectangular configuration.

Next provided is a brush attachment 20 including an outer surface with a cylindrical configuration. The brush attachment has a plurality of bristles 22 coupled to the outer surface which extend radially therefrom. Associated therewith is a rod attachment 24 including a metallic outer surface with a cylindrical configuration having a reduced diameter, as compared with the brush attachment. The rod attachment is equipped with a spring-loaded clamp 28 pivotally coupled to the rod attachment with an angled insulative grip.

Both attachments have a plug 30 coupled to an end thereof and extended therefrom in coaxial relationship therewith. A nub 32 extends radially from a side surface of the plug while a pair of contacts 34 are mounted on a bottom surface thereof. Such contacts are connected to a heater element within the attachment for heating upon the receipt of power. In use, the contacts of the attachments connect with those of the handle upon the insertion and rotation of the plug into the socket.

Figure 3:
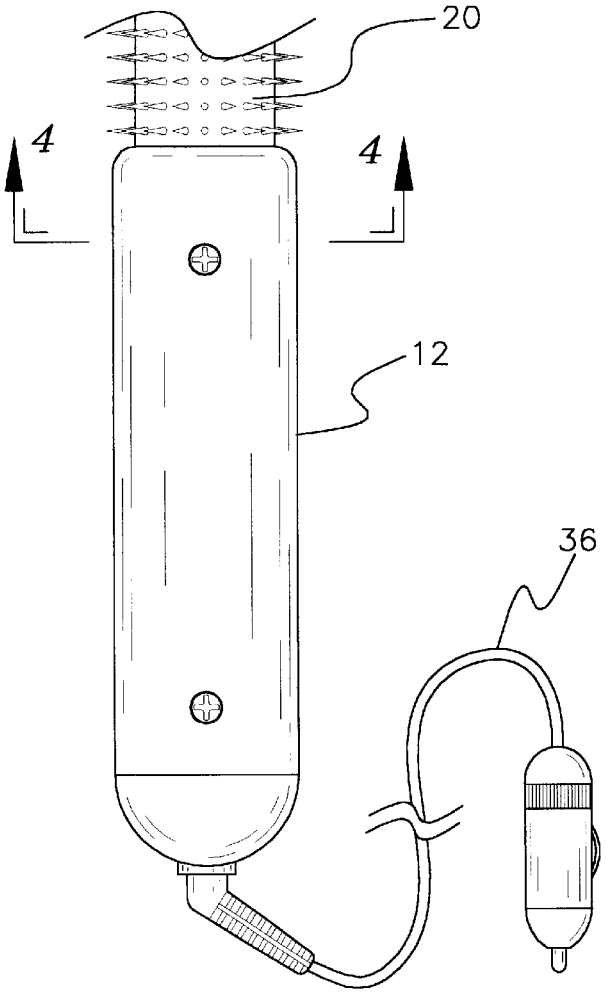
FIG. 3 is a close-up view of the handle of the present invention.

As shown in FIGS. 1 & 3, a power cord 36 includes a first end removably mounted to the first end of the handle. A second end of such cord has an AC/DC adapter 38 for connecting to an alternating current receptacle and converting power received therefrom to DC power. As an option, another power cord may have a cigarette lighter adapter attached thereto for allowing the use of the present invention in a vehicle. Note FIG. 3.

FIG. 1 depicts a manual toggle switch 40 mounted on the planar half of the handle adjacent to the second end. The manual toggle switch is connected between the contacts and the power cord for unconditionally supplying the contacts of the handle with power in a first orientation to heat the heating element. In a second orientation, the supply of power to the contacts of the handle is precluded. For indicating when power is supplied to the heating element of the current attachment, the toggle switch is transparent with a light 42 situated therein for being illuminated when the switch is in the first orientation.

Figure 6:
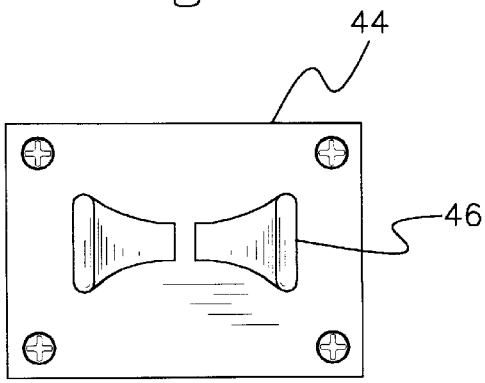
FIG. 6 is a front view of the mounting plate of the present invention.

Mounted on a wall in room or vehicle where the present invention is used is a mounting plate 44. As shown in FIG. 6, the mounting plate includes bracket 46 with an opening for receiving the handle for supporting the same. It should be noted that the bracket may take any form including, but not limited to a closed loop, pocket, clip, clamp or the like.

Finally, a timer unit 48 is provided including a digital display 50 mounted on the planar half of the handle adjacent to the first end. The timer unit is connected between the power cord and the contacts of the handle for supplying power thereto for a predetermined time interval of 30 minutes when activated. The timer units is activated at a user-selected time which is constantly displayed on the digital display. To allow a user to select the time at which the present invention is activated, an hour and minute button may be included. As an option, the digital display may be used to depict a current time when not being used to select an activation time.

As an option, the timer unit may simply supply the contacts with power for a user-selected time interval immediately upon being entered via the buttons. As yet another option, the timer unit may supply the contacts with power for a preset time interval of 30 minutes immediately upon the activation of a switch.

Further, for safety purposes, the timer unit is adapted to supply power to the contacts of the handle only if the same is situated within the mounting plate. This may be accomplished by positioning a magnet within the mounting plate and a reed switch within the handle which is connected between the timer unit and power cord. In the alternative, any other method may be used to disable the timer unit when removed from the mounting plate including but not limited to an adapter, electromagnetic device or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A curling iron with timer comprising, in combination:

a handle having a first end with a hemispherical configuration and a second end with a cylindrical socket with an arcuate slot formed on a side surface thereof and a pair of contacts on a bottom surface thereof, the handle having an intermediate extent one half of which has a semi-cylindrical configuration and one half of which has a planar rectangular configuration;

at least one of a brush attachment and a rod attachment mounted on said handle;

wherein said brush attachment includes an outer surface with a cylindrical configuration having a plurality of bristles coupled to the outer surface and extending radially therefrom, the brush attachment including a plug coupled to an end thereof and extending therefrom in coaxial relationship therewith with a nub extending radially from a side surface thereof and a pair of contacts mounted on a bottom surface thereof which are connected to a heater element within the brush attachment for heating upon the receiving of power, wherein the contacts of the brush attachment connect with said pair of contacts of the handle upon the insertion and rotation of the plug into the socket;

wherein said rod attachment includes an outer surface with a cylindrical configuration having a spring-loaded clamp pivotally coupled to the rod attachment with an angled insulative grip, the rod attachment including a plug coupled to an end thereof and extending therefrom in coaxial relationship therewith with a nub extending radially from a side surface thereof and a pair of contacts mounted on a bottom surface thereof which are connected to a heater element within the rod attachment for heating upon the receiving of power, wherein the contacts of the rod attachment connect with said pair of contacts of the handle upon insertion and rotation of the plug into the socket;

a power cord including a first end mounted to the first end of the handle and a second end having an AC/DC adapter for connecting to an alternating current receptacle and converting power received therefrom to DC power;

a manual toggle switch mounted on a planar half of the handle adjacent to the second end of the handle, the manual toggle switch connected between the contacts of the rod attachment and the power cord for supplying the contacts of the handle with power in a first orientation and further precluding the supply of power to the contacts of the handle in a second orientation, the toggle switch further including a light situated therein for being illuminated when the switch is in the first orientation;

a mounting plate mounted on a wall and having an opening for receiving the handle for supporting the said curling iron; and a timer unit including a digital display mounted on the planar half of the handle adjacent to the first end of the handle, wherein the timer unit is connected between the power cord and the contacts of the handle for supplying power thereto for a predetermined time interval of 30 minutes at a user-selected time which is displayed on the digital display, wherein the timer unit is adapted to supply power to the contacts of the handle only if the curling iron is situated within the mounting plate.

2. A heated curling apparatus comprising:

a handle;

at least one of a brush attachment and a rod attachment mounted on the handle for heating upon the passage of power thereto; and a timer unit connected between a power source and the brush or rod attachment for supplying power thereto for a time interval;

wherein the passage of power starts at a user-selected time; and wherein the user-selected time is displayed on a display on the handle.

3. A heated curling apparatus as set forth in claim 2 wherein the time interval is predetermined and the supply of power starts at a user-selected time.

4. A heated curling apparatus comprising:

a handle;

at least one of a brush attachment and a rod attachment mounted on the handle for heating upon passage of power thereto;

a timer unit connected between a power source and the brush or rod attachment for supplying power thereto for a time interval;

wherein the time interval is predetermined and the passage of power starts at a user-selected time; and wherein the user-selected time is displayed on a display on the handle.

5. A heated curling apparatus as set forth in claim 2 and further including a mounting assembly for receiving the apparatus, wherein the timer unit is adapted to supply power to the rod or brush attachment only if the same is situated within the mounting assembly.

6. A heated curling apparatus as set forth in claim 2 and further including a manual toggle switch mounted on the handle and connected between the rod or brush attachment and a power source for supplying the rod or brush attachment with power in a first orientation and further precluding the passage of power to the rod or brush attachment in a second orientation.

7. A heated curling apparatus as set forth in claim 6 wherein the toggle switch is connected to a light for being illuminated when the switch is in the first orientation.

8. A heated curling apparatus as set forth in claim 2 wherein both a rod attachment and brush attachment are included and removably attachable to the handle.

* * * * *